US008406944B2

(12) United States Patent
Garon et al.

(10) Patent No.: US 8,406,944 B2
(45) Date of Patent: Mar. 26, 2013

(54) CONTROL SYSTEM AND METHOD FOR STARTING AND STOPPING MARINE ENGINES

(76) Inventors: Pierre Garon, Trois-Rivières (CA); Neil Garfield Allyn, Vancouver (CA); Ray Tat Lung Wong, Richmond (CA)

( * ) Notice: Subject to any disclaimer, the term of this patent is extended or adjusted under 35 U.S.C. 154(b) by 405 days.

(21) Appl. No.: 12/703,527

(22) Filed: Feb. 10, 2010

(65) Prior Publication Data

US 2011/0196552 A1 Aug. 11, 2011

(51) Int. Cl.
*B60L 3/00* (2006.01)

(52) U.S. Cl. ..... 701/21; 701/62; 477/99; 440/85

(58) Field of Classification Search ..... 701/21, 701/53, 62; 477/99, 111; 440/85
See application file for complete search history.

(56) References Cited

U.S. PATENT DOCUMENTS 3,782,084 A 1/1974 Harkness
4,033,311 A 7/1977 Burson
4,071,818 A 1/1978 Krisst
4,350,041 A 9/1982 Loker et al.
4,622,930 A * 11/1986 Hamano et al. ..... 477/99
4,836,809 A * 6/1989 Pelligrino ..... 440/2
4,891,758 A 1/1990 Simonyi et al.
4,898,132 A 2/1990 Kanno
4,950,988 A 8/1990 Garshelis
5,142,473 A * 8/1992 Davis ..... 701/21
5,228,548 A 7/1993 Bohlin
6,238,255 B1 * 5/2001 Takase ..... 440/1
6,273,771 B1 * 8/2001 Buckley et al. ..... 440/84
6,587,765 B1 7/2003 Graham et al.
6,595,179 B1 7/2003 Kanno
6,595,897 B1 7/2003 Dykstra et al.
6,823,745 B2 11/2004 Goto et al.
6,832,940 B2 12/2004 Itoi
6,871,555 B2 3/2005 May
7,131,339 B2 11/2006 Kwun et al.
7,133,758 B2 11/2006 Otto et al.
7,142,955 B1 11/2006 Kern et al.
7,179,143 B2 2/2007 Mizuguchi et al.
7,330,782 B2 2/2008 Graham et al.
7,335,070 B2 2/2008 Yoda et al.
7,384,321 B2 6/2008 Muramatsu et al.
7,469,604 B2 12/2008 Hedayat et al.

(Continued)

OTHER PUBLICATIONS

AS5045 12 Bit Programmable Magnetic Rotary Encoder, www.austriamicrosystems.com, 2008.

(Continued)

*Primary Examiner* — Joseph C Rodriguez
(74) *Attorney, Agent, or Firm* — Cameron IP

(57) ABSTRACT

The present invention relates to a start-protection system for an engine of a marine vessel. The engine has gears and a shift actuator for operatively shifting the gears. The system includes a first position sensor disposed to operatively sense whether the engine is in a forward, neutral or a reverse gear position. The first position sensor generates a signal representative of the gear position. The system includes a second position sensor adjacent to a shift control which controls shift functions of the engine. The second position sensor generates a signal representative of the position of the shift control. The system includes processing means. The processing means are configured to receive the signals of the position sensors, determine the gear position and the position of the shift control and enable the engine to start upon determining that both the shift control and the engine are in neutral positions.

14 Claims, 16 Drawing Sheets

U.S. PATENT DOCUMENTS

| | | | | |
|---|---|---|---|---|
| 7,938,702 | B2 * | 5/2011 | Suzuki et al. | 440/1 |
| 8,229,609 | B2 * | 7/2012 | Bamba et al. | 701/21 |
| 2004/0090195 | A1 | 5/2004 | Motsenbocker | |
| 2006/0166573 | A1 | 7/2006 | Vetta et al. | |
| 2007/0227268 | A1 | 10/2007 | Ouyang et al. | |
| 2008/0216589 | A1 | 9/2008 | Shimizu | |
| 2009/0011665 | A1 * | 1/2009 | Sakaguchi et al. | 440/1 |
| 2009/0215338 | A1 | 8/2009 | Suzuki et al. | |
| 2011/0195816 | A1 * | 8/2011 | Martin et al. | 477/115 |

OTHER PUBLICATIONS

AS5000 Series Magnetic Sensor Circuits, Magnet Selection Guide, www.austriamicrosystems.com, 2008.

BRP Evinnide Icon Interactive Control System Press Release, Feb. 12, 2009, Bombardier Recreational Products Inc., Miami, Florida.

* cited by examiner

| Lever position | Gear command | Throttle command | Gear lamps |
|---|---|---|---|
| FORWARD WOT | Forward | 100% | ▲ ○ ▽ |
| FORWARD | Forward | 0 - 100% | |
| FORWARD DETENT | Forward | 0% | |
| NEUTRAL DETENT | Neutral | 0% | △ ● ▽ |
| REVERSE DETENT | Reverse | 0% | △ ○ ▼ |
| REVERSE | Reverse | 0 - 60% | |
| REVERSE WOT | Reverse | 60% | |

FIG. 5

CONTROL SYSTEM AND METHOD FOR STARTING AND STOPPING MARINE ENGINES

FIELD OF THE INVENTION

The present invention relates to a control system and method for marine engines. In particular, the invention relates to a control system and method for starting and stopping marine engines.

DESCRIPTION OF THE RELATED ART

It may be dangerous to have an engine of a marine vessel start running while in gear. When this occurs, the vessel may suddenly start moving and the occupants of the marine vessel may be jolted around, or worse, thrown out of the vessel. With a mechanically driven engine (as opposed to a drive-by-wire engine), a mechanical push-pull cable maintains a fixed relationship between the control lever (also known as the control handle) and shift actuator arm. The US Coast Guard requires a neutral start protection by monitoring the position of the control lever. Electronic shift and throttle systems eliminated the fixed link between the control handle and shift actuator arm. Electronic shift and throttle systems such as disclosed in U.S. Pat. No. 7,330,782 to Graham et al., only monitor the shift actuator position.

To the extent that existing starting systems are limited in their ability to inhibit an engine from starting while in gear, there exists a need for an improved start-protection system.

BRIEF SUMMARY OF INVENTION

The present invention provides a start-protection system disclosed herein that overcomes the above disadvantages. It is an object of the present invention to provide an improved start-protection system. It is also an object of the present invention to provide an improved control system and method for starting and stopping marine engines.

There is accordingly provided a method for starting an engine of a marine vessel. The engine has gears and a shift actuator for operatively shifting the gears. The method includes providing a first position sensor disposed to operatively sense whether the engine is in a forward, neutral or reverse gear position. The first position sensor generates a signal representative of the gear position. The method includes disposing a second position sensor adjacent to a shift control which controls shift functions of the engine. The second position sensor generates a signal representative of the position of the shift control. The method includes providing processing means. The processing means receives the signals of the position sensors, determines the gear position and the position of the shift control and enables the engine to start upon determining that both the shift control and the engine are in neutral positions.

According to yet another aspect, there is provided a start-protection system for an engine of a marine vessel. The engine has gears and a shift actuator for operatively shifting the gears. The system includes a first position sensor disposed to operatively sense whether the engine is in a forward, neutral or a reverse gear position. The first position sensor generates a signal representative of the gear position. The system includes a second position sensor adjacent to a shift control which controls shift functions of the engine. The second position sensor generates a signal representative of the position of the shift control. The system includes processing means. The processing means are configured to receive the signals of the position sensors, determine the gear position and the position of the shift control and enable the engine to start upon determining that both the shift control and the engine are in neutral positions.

According to yet a further aspect, there is provided a multiplexed start system for a first marine engine and a second marine engine. The system includes a first start switch for a first engine and a second start switch for the second engine. The system includes a control head connected to the first start switch and the second start switch. The control head includes a control lever which controls shift functions of the engines. The control head includes a control head processor. The system includes a lever position sensor disposed adjacent to the control lever. The lever position sensor generates a signal representative of the position of the control lever. The control head processor is configured to receive the signal of the lever position sensor and determine the position of the control lever. The system includes a communications link. The control head is connected to the communications link. The system includes a first servo controller having a servo processor. The first servo controller is connected to the control head via the communications link. The system includes a second servo controller having a servo processor. The second servo controller is connected to the control head via the communications link. The system includes a first engine having gears and a shift actuator for shifting said gears. The shift actuator has a neutral position in which said gears are disengaged. The first engine has an engine control unit for operatively starting the first engine. The engine control unit is in paired communication with the first servo controller. The system includes a second engine having gears and a shift actuator for shifting said gears of the second engine. The shift actuator of the second engine has a neutral position in which the gears of the second engine are disengaged. The second engine has an engine control unit for operatively starting the second engine. The engine control unit of the second engine is in paired communication with the second servo controller. The system includes a first shift actuator position sensor disposed adjacent to the shift actuator of the first engine. The first shift actuator position sensor generates a signal representative of the position of the shift actuator of the first engine. The first servo processor is configured to receive the signal of the first shift actuator position sensor and determine the position of the shift actuator of the first engine. The system includes a second shift actuator position sensor disposed adjacent to the shift actuator of the second engine. The second shift actuator position sensor generates a signal representative of the position of the shift actuator of the second engine. The second servo processor is configured to receive the signal of the second shift actuator position sensor and determine the position of the shift actuator of the second engine. When one of the first switch and the second switch is actuated and the control head processor determines that the control lever is in a neutral position, the control head processor transmits an engine start message to the corresponding one of the first servo controller processor and the second servo controller processor. When the one of the first servo controller processor and the second servo controller processor receives its engine start message and determines that its corresponding engine's shift actuator is in neutral, the one of the first servo controller processor and the second servo controller processor transmits a signal to its paired one of the first engine control unit and the second engine control unit to start its associated one of the first engine and the second engine.

According yet an even further aspect, there is provided a multiplexed stop system for a first marine engine and a second marine engine. The system includes a first stop switch for stopping operation of the first engine. The system includes a second stop switch for stopping operation of the second engine. The system includes a control head connected to the first stop switch and the second stop switch. The control head has a control head processor. The system includes a communications link. The control head is connected to the communications link. The system includes a first engine having an engine control unit for operatively stopping the first engine. The engine control unit is connected to the control head via the communications link. The system includes a second engine having an engine control unit for operatively stopping the second engine. The engine control unit of the second engine is connected to the control head via the communications link. When one of the first stop switch and the second stop switch is actuated, the control head processor transmits a stop message via the communications link to the engine control unit of the corresponding one of the first engine and the second engine to stop operation of said one of the first engine and the second engine.

There is also provided an emergency stop system for a marine engine. The system includes a control head and an electronic servo module for the engine. The system includes a lanyard switch for stopping the engine. The system includes a cable comprising a communications link and a pair of emergency stop conductors connected to the engine. The control head and the electronic servo module are connected to the communications link. The pair of emergency stop conductors connected to the lanyard switch. Actuating the lanyard switch causes a lanyard signal to be transmitted to the engine via the emergency stop conductors to stop the engine. The control head and the electronic servo module are configured to read the lanyard switch state via the emergency stop conductors. The control head and the electronic servo module are configured to also transmit the lanyard signal to the engine via the communications link.

BRIEF DESCRIPTION OF DRAWINGS

The invention will be more readily understood from the following description of preferred embodiments thereof given, by way of example only, with reference to the accompanying drawings, in which:

FIG. 5 is a table illustrating the lighting of indicator or gear lamps as the control lever of FIG. 4 is moved through the operational range;

DESCRIPTION OF THE PREFERRED EMBODIMENTS

Figure 1:
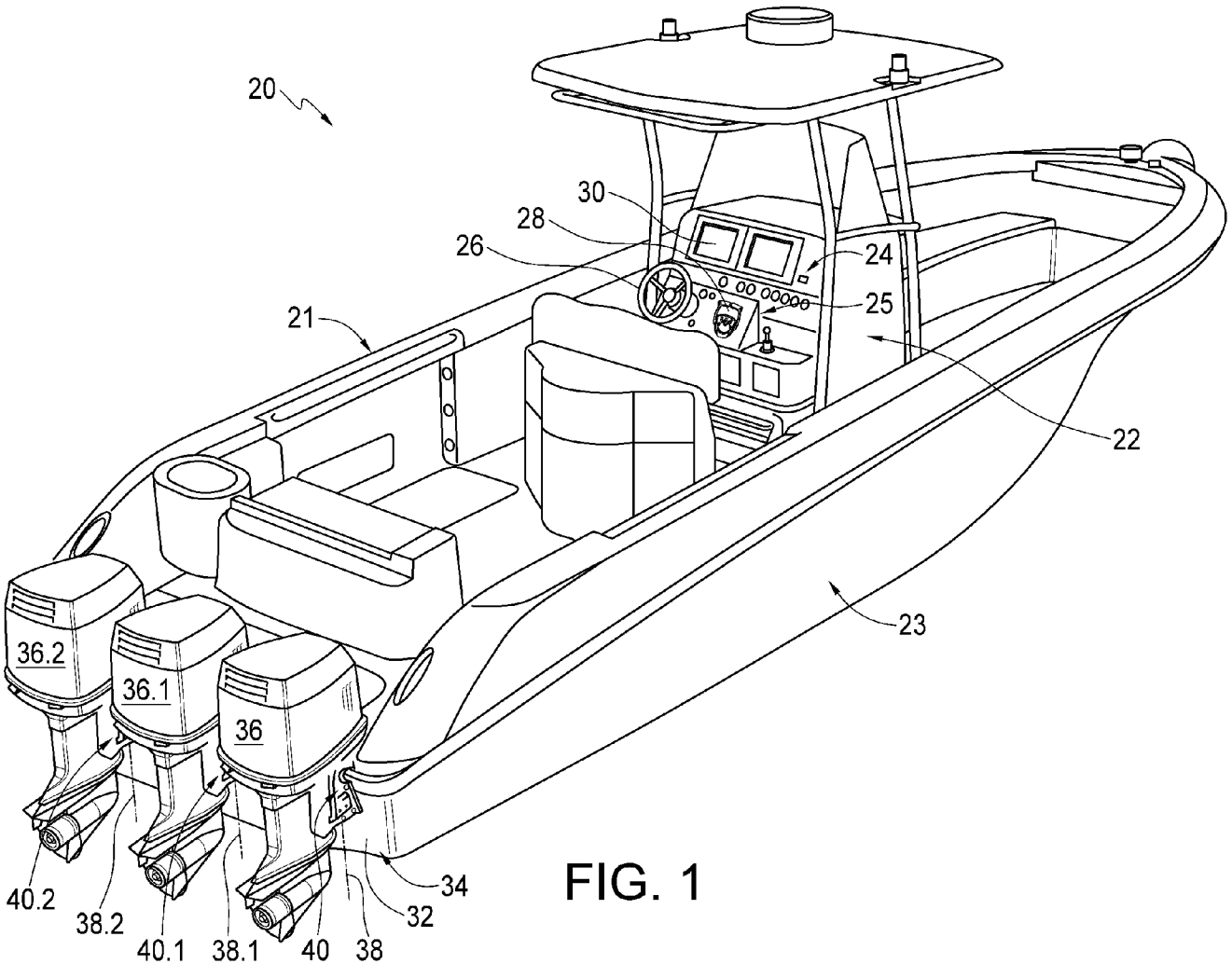
FIG. 1 is a perspective view of a marine vessel having a steering apparatus and propulsion units mounted thereon.

Referring to the drawings and first to FIG. 1, there is shown a marine vessel 20 having a control system 22 for operatively controlling and steering the vessel. The control system 22 includes a user interface 24 that provides for warnings and a means for adjusting of the system. A buzzer and a warning lamp are employed in the system in this example and a textual or graphic interface 30 can also be used. The control system 22 includes a helm 26 for steering the marine vessel 20.

Figure 2:
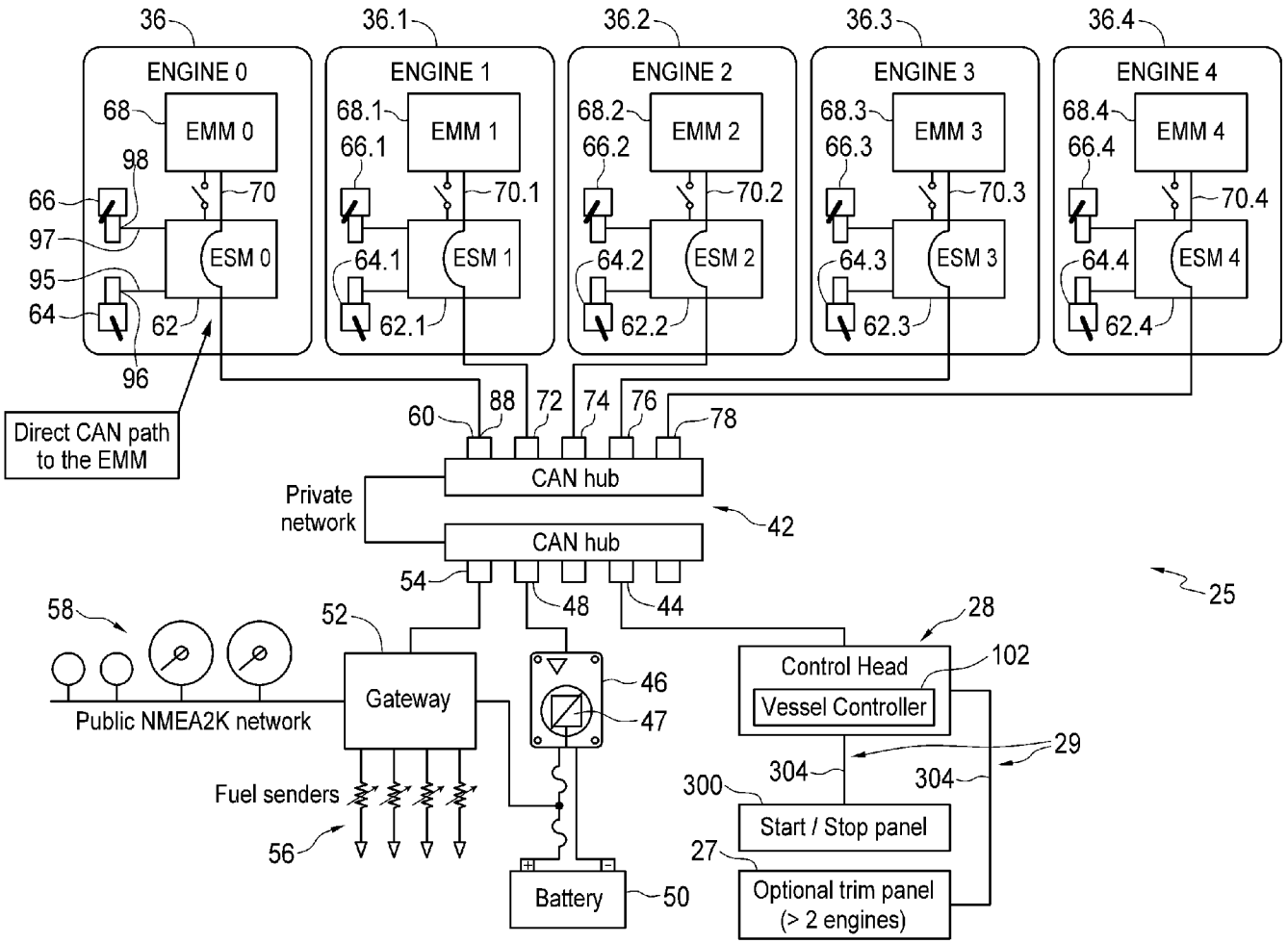
FIG. 2 is a schematic view of an electronic shift and throttle system that includes a plurality of engine assemblies similar to those of the marine vessel of FIG. 1.
Figure 6:
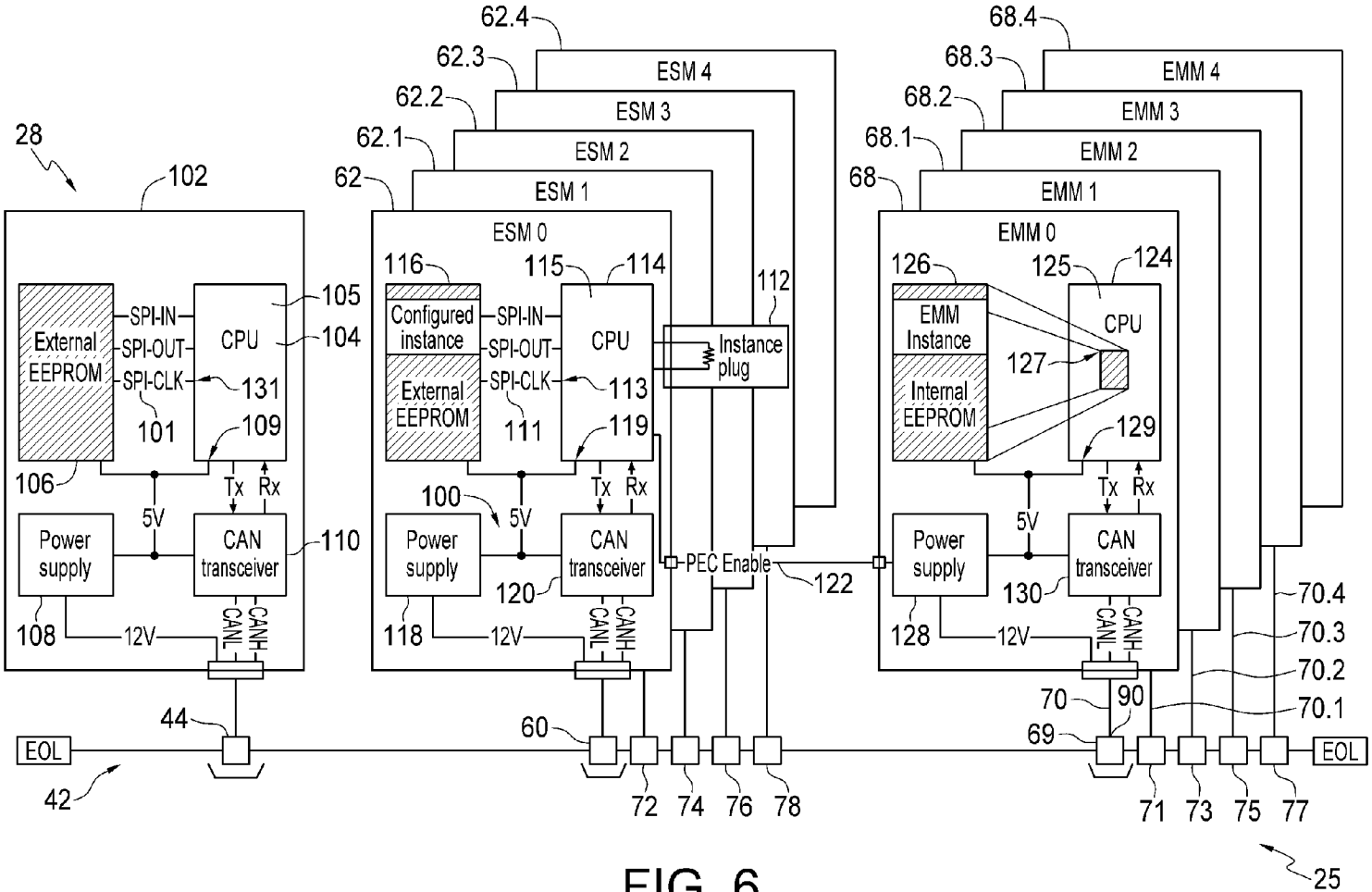
FIG. 6 is a schematic diagram of the system shown in FIG. 2 including a vessel controller, a plurality of electronic servo modules, and a plurality of engine management modules.
Figure 13:
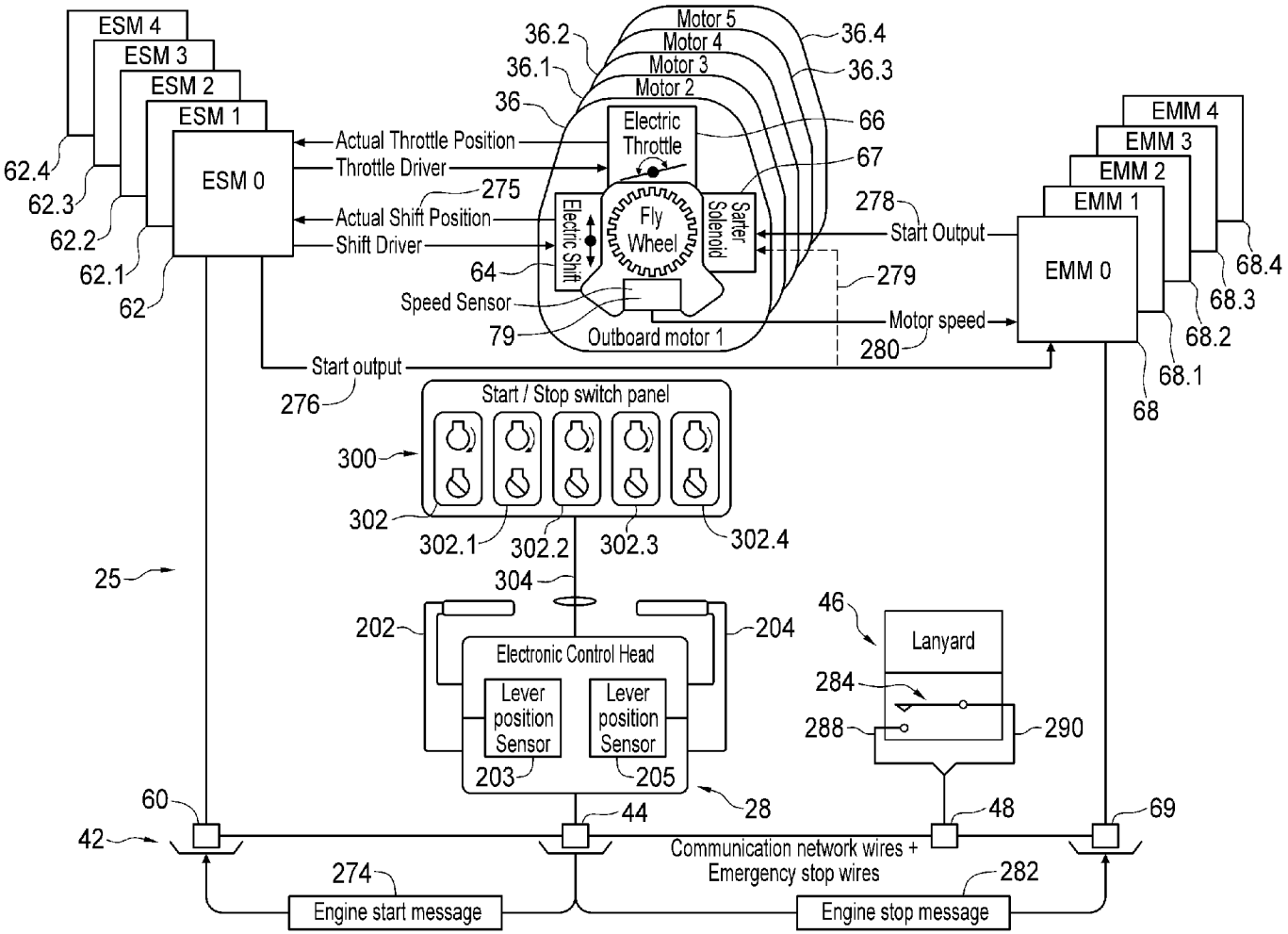
FIG. 13 is a schematic view of the electronic shift and throttle system showing engine start and stop features and their operation.

The marine vessel 20 has propulsion units, in this example, comprising three engines, in this case, outboard engines 36, 36.1, and 36.2. FIGS. 2, 6 and 13 include an additional two engines as described below. Engine 36.2 is positioned adjacent to a port side 21 of the vessel 20. Engine 36 is positioned adjacent to a starboard side 23 of the vessel 20. Engine 36.1 is disposed in a center position, in this example midway between the port side 21 and the starboard side 23. While three engines are shown in FIG. 1, those skilled in the art will appreciate that the present invention may equally be directed to two or more engines, including but not limited to five engines in one preferred embodiment shown in FIGS. 2, 6 and 13. The outboard engines 36, 36.1 and 36.2 are mounted to steering apparatuses 40, 40.1 and 40.2, respectively, which in turn are mounted to the stern 34 of the vessel 20, in this case via transom 32 of the vessel 20. The outboard engines 36, 36.1 and 36.2 can rotate about steering axes 38, 38.1 and 38.2, respectively. The outboard engines and steering apparatuses are substantially the same in construction and function, and are known per se to those skilled in the art. The outboard engines and steering apparatuses will therefore not be discussed in further detail.

The marine vessel 20 has an electronic shift and throttle system 25 as shown schematically in FIG. 2. Electronic shift and throttle systems per se are known, as for example disclosed in U.S. Pat. No. 7,330,782 to Graham et al., the disclosure in which is incorporated herein by reference.

Figure 3:
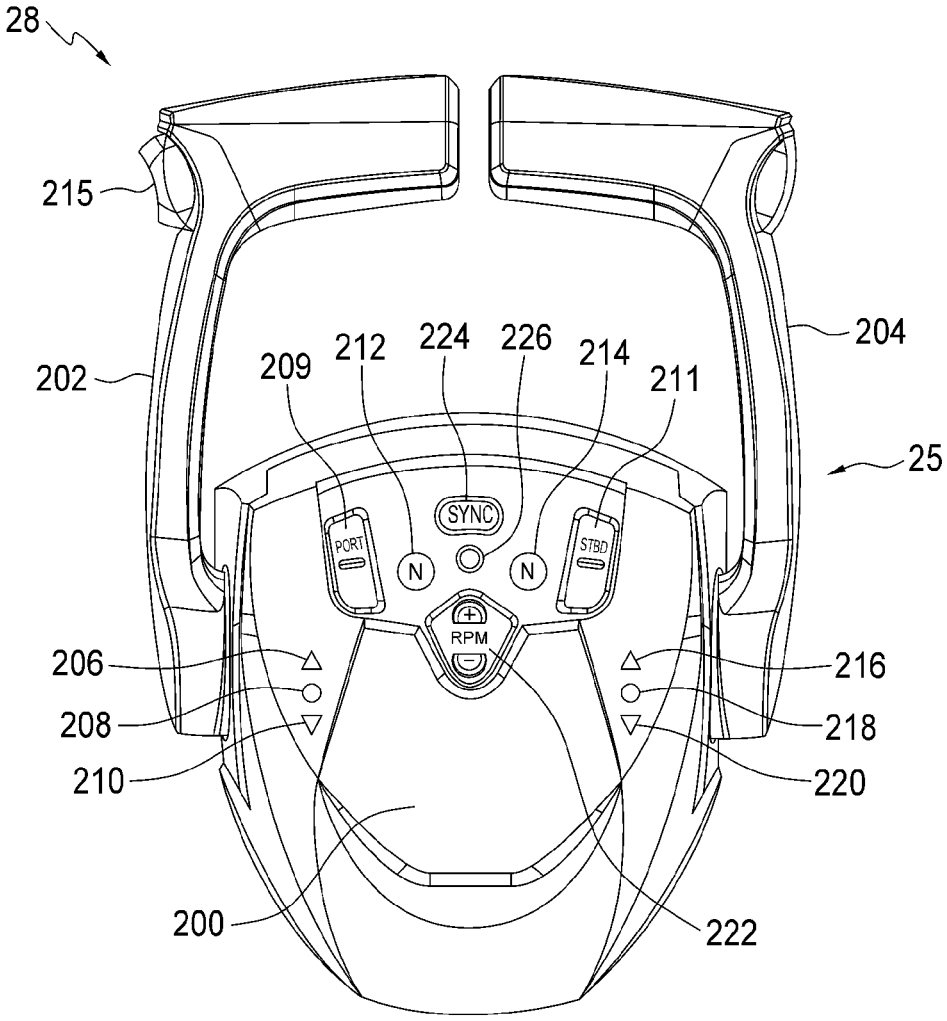
FIG. 3 is a front elevation view of a control head for the system shown in FIG. 2.

The system 25 includes a shift and throttle controller, shown in FIG. 1 by way of a control head 28. Referring to FIG. 3, the control head 28 is shown in greater detail, according to one example. While only one control head is shown, those skilled in the art will appreciate that two or more control head stations may be used in other embodiments.

The control head 28 includes a housing 200. The control head 28 has a shift control in this example in the form of a port control lever 202 and a starboard control lever 204. Levers 202 and 204 are each pivotally mounted on the housing 200. Levers 202 and 204 adjust shift actuators and throttle actuators of the engines. Port control lever 202 controls the shift and throttle functions of the one or more engines positioned adjacent to the port side 21 of the marine vessel. Starboard control lever 204 controls the shift and throttle functions of the one or more engines positioned adjacent to the starboard side 23 of the marine vessel. The center engine, if any, is under the control of one of the levers 202 and 204, and in this example lever 202.

The housing 200 also supports a plurality of indicator or gear lamps which, in this example, are LED lamps. A port forward indicator 206, port neutral indicator 208, and port reverse indicator 210 are disposed on a side of housing 200 adjacent the port control lever 202. A starboard forward indicator 216, starboard neutral indicator 218, and a starboard reverse indicator 220 are disposed on a side of housing 200 adjacent the starboard control lever 204. A port trim up/down means 209 and a starboard trim up/down means 211 are disposed on the housing 200. A master trim up/down means 215 for commanding the trim of all the engines at once is located on the port control lever 202, in this example. Port neutral input means 212 and starboard neutral input means 214 are also disposed on the housing 200. An RPM input means 222, synchronization (SYNC) input means 224, and SYNC indicator lamp 226 are also all disposed on the housing 200. In this example, the port neutral input means 212, starboard neutral input means 214, RPM input means 222, and SYNC input means 224 are buttons but any suitable input devices may be used.

Figure 4:
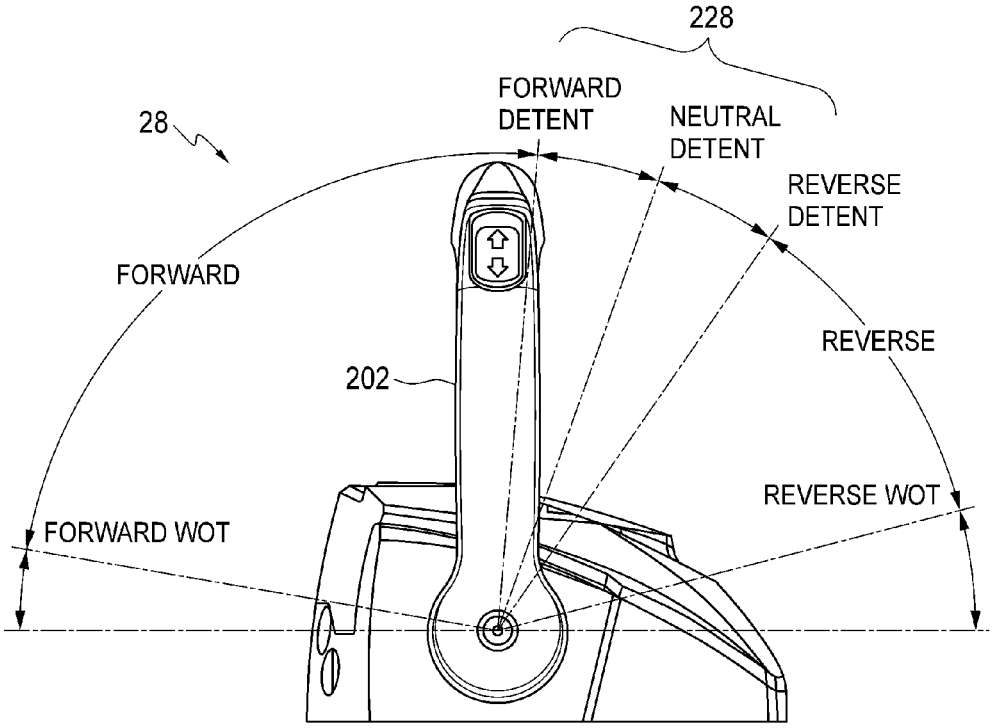
FIG. 4 is a side elevation view of the control head of FIG. 3 illustrating an operational range of a control lever thereof.

Referring now to FIG. 4, the port side control lever 202 is moveable between a forward wide open throttle (WOT) position and a reverse wide open throttle (WOT) position. The operator is able to control the shift and throttle functions of the one of more port engines by moving the port control lever 202 through its operational range. The port control lever 202 is also provided with a forward detent, neutral detent, and reverse detent operatively disposed between the forward WOT position and reverse WOT position. These allow the operator to physically detect when the port control lever 202 has moved into a new shift/throttle position. The port control lever 202 has a neutral position 228 between the forward detent and the reverse detent. As shown in FIG. 5, the port forward indicator 206, port neutral indicator 208, and port reverse indicator 210 light up to reflect the position of the port control lever 30. The control head 28 reads the position of the port control lever 202 and, via a vessel controller 102 (shown in FIG. 2), sends shift and throttle commands to the electronic servo modules shown in FIG. 2 via a private CANbus communications network 42.

It will be understood by a person skilled in the art that the shift and throttle functions of the starboard engines are controlled in a similar manner using the starboard control lever 204 shown in FIG. 3. The shift and throttle functions of the center engine 202 are under the control of the port control lever 202 in this example.

Referring to FIG. 13, the system 25 includes a port lever position sensor 203, which in this example is part of the control head 28, for reading the position of the port control lever 202. The port lever position sensor 203 is disposed adjacent to the port control lever 202. In this example the port lever position sensor 203 transmits a signal representative of the position of the port control lever 202. The system 25 also includes a starboard lever position sensor 205, which is part of the control head 28, for reading the position of the starboard control lever 204. The starboard lever position sensor 205 is disposed adjacent to the starboard control lever 204. The starboard lever position sensor 205 transmits a signal representative of the position of the starboard control lever 204. The position sensors 203 and 205 are electrically connected to the vessel controller 102. Each position sensor sends an electrical signal to the vessel controller. The vessel controller is able to determine the position of each control lever based on the voltage level of the electrical signal received from the corresponding position sensor.

Position sensors for control levers are known per se. The position sensors 203 and 205 may include a potentiometer, for example, or other such device that senses the current position of the corresponding control lever within its operating range. A potentiometer is merely an example of a position sensing device. Other position sensors, such as Hall effect sensors, for example, can also be used to sense the position of the control levers.

U.S. Pat. No. 7,330,782 issued on Feb. 12, 2008 to Graham et al., the full disclosure of which is incorporated herein by reference, discloses an electronic shift and throttle system in which a position sensor is used to sense the position of a control lever. The position sensor is electrically connected to a vessel controller (or electronic control unit (ECU)) and sends an electrical signal to the ECU. The ECU is able to determine the position of the control lever based on the voltage level of the electrical signal received from the position sensor.

Referring back to FIG. 2, the electronic shift and throttle system 25 includes a vessel controller 102. In this example the vessel controller 102 is located within, and as part of, the control head 28 shown in FIG. 3, though this is not required.

The system 25 includes a start/stop switch panel 300. As best shown in FIG. 13, the panel 300 has a plurality of start/stop switches for selectively starting or stopping corresponding engines, in this example switches 302, 302.1, 302.2, 302.3 and 302.4. The switches may also be referred to as start switches or stop switches. The switches are connected to and in communication with the vessel controller 102 of the control head 28 via a serial communications link 304 in this example. Alternatively, the switches may be connected to the control head 28 via discrete wires.

Referring back to FIG. 2, trim functions may be achieved via a trim switch panel 27 that connects to the control head 28 via a LIN bus 29.

As previously mentioned the system 25 includes a communications link, in this example a standard network connection, namely the CANbus communications network 42. These are well-known in the art. The vessel controller 102 is operatively connected to the CANbus communications network 42 via input/output pin 44. While the CANbus communications network 42 is shown, one skilled in the art will appreciate that dual redundant communication architecture can be used in the system described herein.

The system 25 includes a master key switch panel 46 with a master ignition key switch 47 connected to the CANbus communications network 42 via pin 48. The system 25 includes a power supply, in this example battery 50 operatively connected to the ignition switch 47. Battery 50 supplies CAN power to the entire private CANbus communications network 42. Regardless of the number of engines, the battery power provided to the electronic servo controllers is turned on and off from a single master key switch 47. Turning the key switch 47 to the on position brings the system 25 alive. Turning the key switch 47 to the off position shuts the system 25 down.

The system 25 in this example has a gateway 52 connected to the CANbus communications network 42 via pin 54. The private CANbus communications network 42 of the system 25 interfaces with a public network, in this example a public NMEA2K network 58, via the gateway 52. NMEA2K is a standard for serial data neworking of marine electronic devices on CAN. Information from the system 25 is made available to the public NMEA2K network 58 via the gateway 52. The gateway 52 isolates the system 25 from public messages, but transfers engine data to displays and gauges. The gateway 52 has four analog inputs 56 which can be used to read fuel sender information and broadcast this information on the public network 58. Ignition switch systems, gateways, fuel senders, and interfacing networks per se are known and therefore will not be discussed further.

The system 25 in this example includes five outboard engines 36, 36.1, 36.2, 36.3, and 36.4. Switches 302, 302.1, 302.2, 302.3 and 302.4, shown in FIG. 13, are for selectively starting or stopping corresponding engines 36, 36.1, 36.2, 36.3, and 36.4, respectively. The switches 302, 302.1, 302.2, 302.3 and 302.4 are read by the control head 28 as digital inputs. Each of the engines has substantially the same components and functions in substantially the same way. Like parts have like numbers, with the addition of ".1" for engine 36.1, ".2" for engine 36.2 and likewise for the other engines 36.3 and 36.4.

Engine 36 is labelled ENGINE 0 in FIG. 2. Engine 36 includes an engine control unit, in this example an engine management module (EMM) 68. EMMs are shown in FIGS. 2, 6 and 13. The engine management module 68 is coupled to the CANbus communications network 42 via conductor 70 and input/output pin 69, as shown in FIG. 6. Engine management module 68.1 is coupled to the CANbus communications network 42 via input/output pin 71. Engine management module 68.2 is coupled to the CANbus communications network 42 via input/output pin 73. Engine management module 68.3 is coupled to the CANbus communications network 42 via input/output pin 75. Engine management module 68.4 is coupled to the CANbus communications network 42 via input/output pin 77.

Engine 36 has a servo controller, in this example an electronic servo module (ESM) 62. ESMs are shown in FIGS. 2, 6 and 13. Electronic servo module 62 is operatively connected to the engine management module 68, as for example shown in FIG. 6 by conductor 122 of a printed electric circuit board. In like manner the rest of the electronic servo modules are operatively connected to respective engine management modules. Each electronic servo module may thus be said to have a peer or paired engine management module with which it is associated.

Referring back to FIG. 2, the electronic servo module 62 is coupled to the CANbus communications network 42 via input/output pin 60. Electronic servo module 62.1 is coupled to the CANbus communications network 42 via input/output pin 72, electronic servo module 62.2 is coupled to the CANbus communications network 42 via input/output pin 74, electronic servo module 62.3 is coupled to the CANbus communications network 42 via input/output pin 76, and electronic servo module 62.4 is coupled to the CANbus communications network 42 via input/output pin 78.

The vessel controller 25, the electronic servo modules, and the engine management modules are thus communicatively coupled to one another via the CANbus communications network 42. The vessel controller 25, the electronic servo modules, and the engine management modules can pass messages to one another via the CANbus communications network 42 using a predefined protocol, such as the well-known NMEA 2000 protocol. Though CANbus communications network 42 and NMEA 2000 are provided by way of example, it should be understood that the communications link can be any suitable communications link and can employ any suitable communications protocol.

Referring to FIG. 6, the internal components of the vessel controller 102, the electronic servo module 62, and the engine management module 68 will now be described in further detail.

The vessel controller 102 has inputs and outputs, in this example, collectively in the form of transceiver 110. The transceiver 110 in this example is a CAN transceiver, namely a Philips PCA82C251. The transceiver 110 is coupled to the input/output pin 44 of the CANbus communications network 42. The vessel controller 102 includes a host processor 104, which is preferably an embedded microcontroller. The host processor 104 may be referred to a control head processor. The transceiver 110 is operatively connected to the host processor 104. The transceiver 110 receives and transmits signals, which are in turn sent to the processor 104.

The host processor 104 in this example is an Infineon XC164CS type CPU, though other processors may be used. The host processor 104 hosts control software 105 that controls the vessel controller 102. The host processor 104 may be referred to as part of a command means of the vessel controller 102. According to one aspect, the host process 104 can perform the task of comparing data numbers.

The vessel controller 102 includes memory, in this example external electrically erasable programmable read-only memory (EEPROM) 106. The external EEPROM 106 in this example is in the form of a microchip 25LC160A. Memory 106 is operatively connected to the host processor 104. The vessel controller 102 provides a clock signal 101 to the external EEPROM that is electrically connected to an output pin 131 of the host processor 104. The vessel controller 102 includes a power supply 108. In this example the power supply 108 is a 12V power supply that is electrically connected to an input pin 109 of the host processor 104 in a manner configured to provide 5V to the host processor 104.

Host processors, control software, memory, and clocks per se are well known to those skilled in the art, as for example disclosed in U.S. Pat. No. 7,330,782, the disclosure of which is incorporated herein by reference. Thus their operation and various components will not be described in great detail.

As previously mentioned the control lever position sensors 203 and 205, shown in FIG. 13, are electrically connected to the vessel controller 102 shown in FIG. 6. The control lever position sensors 203 and 205 are in this example electrically connected to an analog to digital converter (not shown) which is in turn connected to the host processor 104, shown in FIG. 6. Each of the position sensors 203 and 205 is provided with an electrical signal via a power supply. The position sensors cause the voltage of the electrical signal to vary as the control levers 202 and 204 move within their operating range. The potentiometer provides a variable resistance that causes the voltage of the electrical signal to vary linearly as the position of each control lever varies. Thus, the voltage of electrical signal out of the potentiometer, which is forwarded to the host processor 104, represents the position of a control lever within its operating range.

Still referring to FIG. 6, electronic servo module 62 has an input, in this example, a transceiver 120 for receiving commands from the vessel controller. The transceiver 120 in this example is a CAN transceiver, namely a Philips PCA82C251. The transceiver 120 may receive and transmit signals across the CANbus communications network 42.

Electronic servo module 62 includes a processor 114. The processor 114 may be referred to as a servo controller processor. The vessel controller 102 and the electronic servo module 62 may be referred to collectively as a processing means. The transceiver 120 is operatively connected to the processor 114. The transceiver 120 receives and transmits signals, which are in turn sent to the processor 114. The processor 114 hosts control software 115 that at least in part controls the electronic servo module 62.

Electronic servo module 62 has memory, in this example external electrically erasable programmable read-only memory (EEPROM) 116. The external EEPROM 116 in this example is in the form of a microchip 25LC160A. Memory 116 is operatively connected to the processor 114. A data holder, in this example an instance plug 112, containing an address for electronically identifying the electronic servo module, is shown connected to the processor 114. In this example the address of the instance plug 112 is an instance number. Electronic servo module 62 in this example has an instance number of 0, is shown connected to the processor 114. Memory 116 receives and stores this instance number of the electronic servo module 62. The electronic servo module 62 provides a clock signal 111 to the external EEPROM that is electrically connected to an output pin 113 of the host processor 114. The electronic servo module 62 includes a power supply 118. Preferably the power supply 118 is a 12V power supply that is electrically connected to an input pin 119 of the processor 114 in a manner configured to provide 5V to the processor 114.

Electronic servo module 62.1 is substantially the same as that described above with the exception that it may have a different instance number. In this example it has an instance number of 1, as determined by its corresponding instance plug. Also in this example: electronic servo module 62.2 has an instance number of 2; electronic servo module 62.3 has an instance number of 3; and electronic servo module 62.4 has an instance number of 4. These different instance numbers are each known to the vessel controller 102 for the purposes of distinguishing between the electronic servo modules. The particular instance numbering scheme described are for illustration purpose only. Any other numbering or lettering or even naming scheme, such as defined by NMEA2K, can also be employed with this instancing method.

Engine management module 68 has an input and an output, in this example, collectively in the form of transceiver 130. The transceiver 130 in this example is a CAN transceiver, namely a Philips PCA82C251. Engine management module 68 includes a processor 124, which is preferably an embedded microcontroller. The processor 124 may be referred to as an engine controller processor. The processor 124 in this example is a Freescale HCS12 type CPU, though other processors may be used. The transceiver 130 is operatively connected to the processor 124. The transceiver 130 receives and transmits signals, which are in turn sent to the processor 124. The processor 124 hosts control software 125 that at least in part controls the engine management module 68.

Engine management module 68 includes a power supply 128. Preferably the power supply 128 is a 12V power supply that is electrically connected to an input pin 129 of the processor 124 in a manner configured to provide 5V to the processor 124.

Engine management module 68 has memory, in this example electrically erasable programmable read-only memory (EEPROM) 126, internal to the processor 129. The memory 126 is electrically connected to an input/output pin 127 of the processor 124. Memory 126 is operatively connected to the processor 124. The memory 126 stores an address electronically identifying the engine management module 68, in this example an instance number.

In the example shown the engine management modules have instance numbers that are different from each other. These different instance numbers are each known to the vessel controller 102 for the purposes of distinguishing between the engine management modules. Engine management module 68 in this example has an initial instance number of 0. In this example: engine management module 68.1 has an initial instance number of 1; engine management module 68.2 has an initial instance number of 2; engine management module 68.3 has an initial instance number of 3; and engine management module 68.4 has an initial instance number of 4.

As previously mentioned the electronic servo module 62 is operatively connected to the engine management module 68 via conductor 122. The system 25 includes a printed electrical circuit board that links the processor 114 of the electronic servo module 62 to the power supply 128 of the engine management module 68. The other electronic servo modules are connected to their paired engine management modules in the same manner, respectively.

Figure 7:
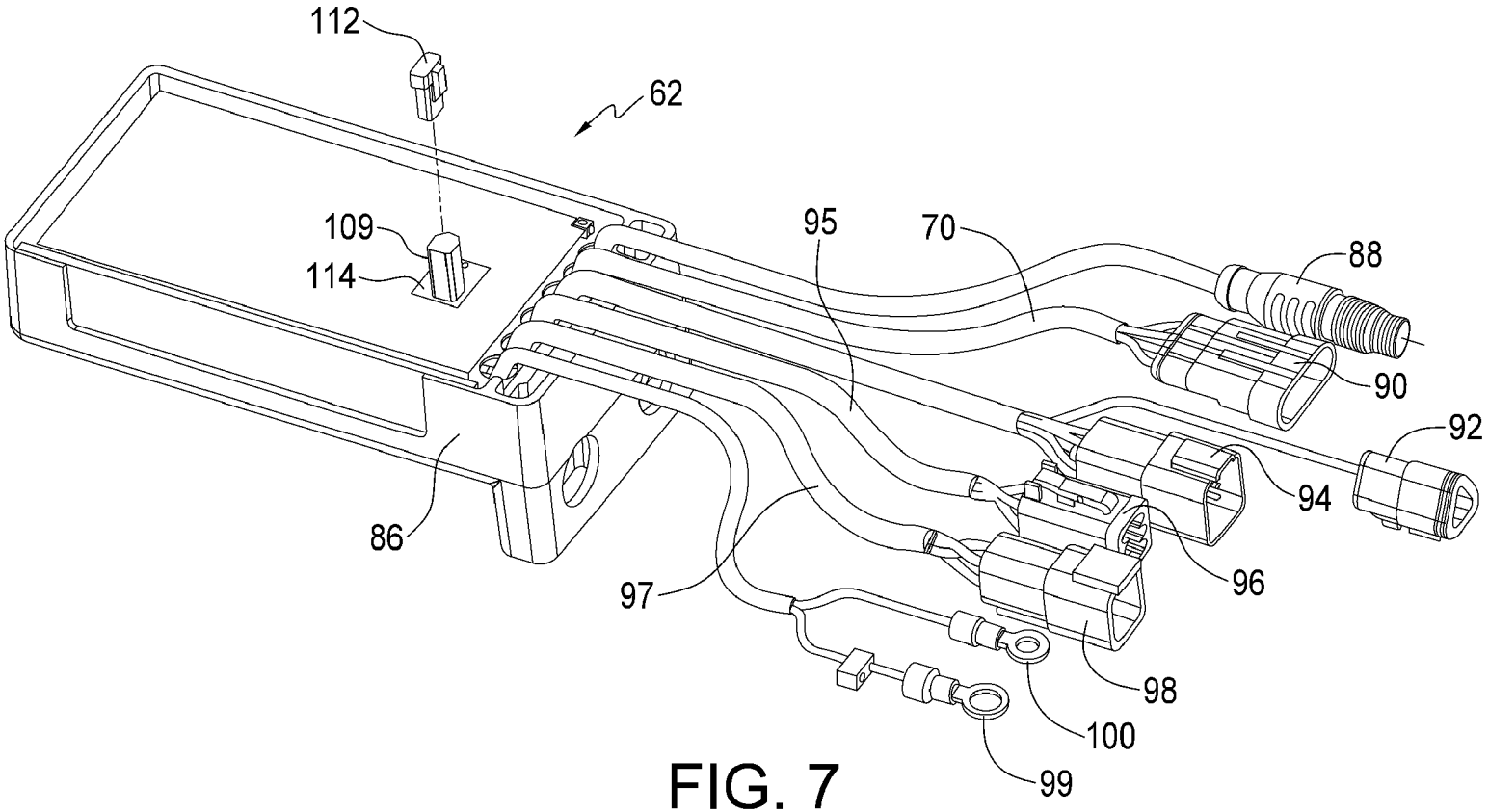
FIG. 7 is a perspective view of an electronic servo module for the system shown in FIG. 2.

Referring to FIG. 7, this shows an example of the electronic servo module 62 in physical form, with its power supply not shown. The electronic servo module 62 includes a housing 86. The instance plug 112 is received by socket 109 of the electronic servo module 62. Socket 109 is operatively connected to the processor 114. The electronic servo module 62 has a plurality of connectors. Connector 88 connects the electronic servo module 62 to the CANbus communications network 42. Connector 90 enables the engine management module 68 to connect to the CANbus communications network 42. Connectors 92 and 94 are related to trim functions of the engine, the systems for which are known and will not be discussed further. Connectors 99 and 100 connect the electronic servo module 62 to its power supply. The electronic servo module 62 also includes conductor 97 with connector 98, and conductor 95 with connector 96.

Referring back to FIG. 2, engine 36 includes a throttle actuator 66 operatively coupled to the electronic servo module 62 via conductor 97 and connector 98. Engine 36 also includes a shift actuator 64 for shifting gears. The shift actuator 64 is operatively coupled to the electronic servo module 62 via conductor 95 and connector 96. The electronic servo modules drive the shift and throttle actuators. Throttle actuators and shift actuators per se are known to those skilled in the art.

Figure 8:
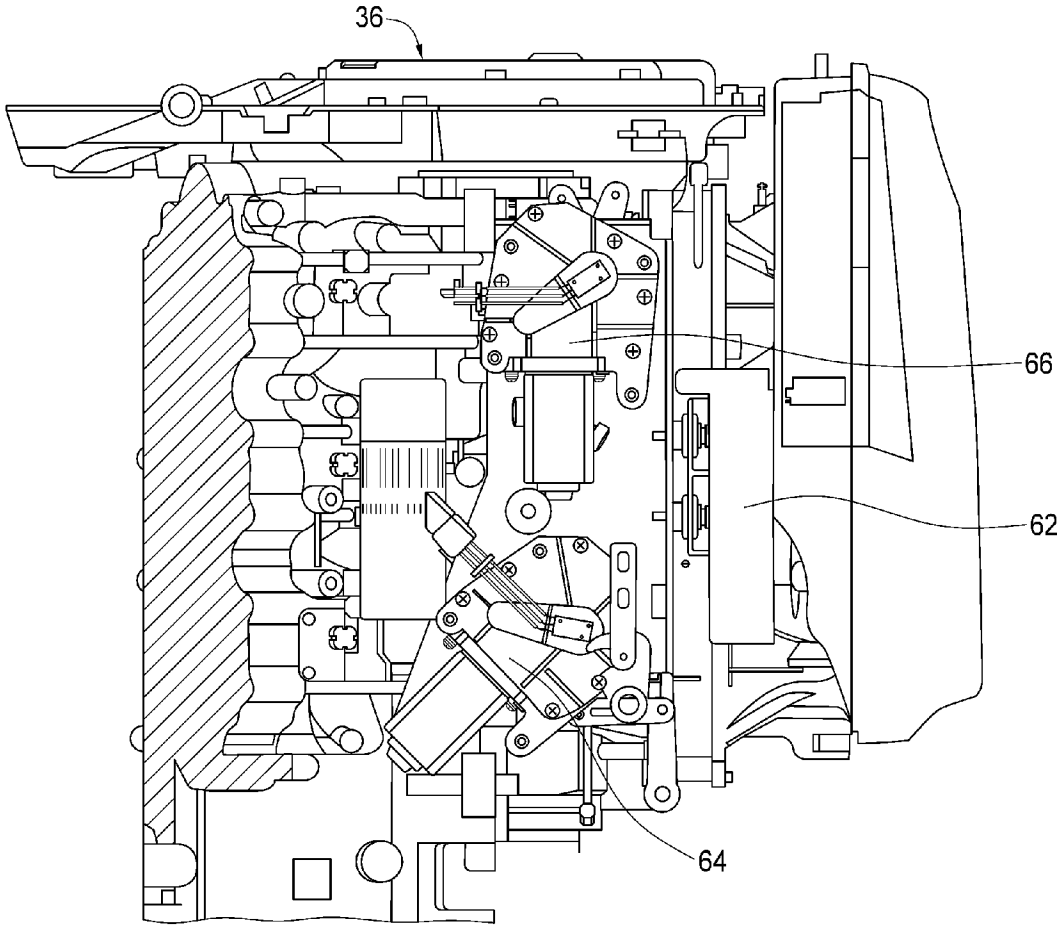
FIG. 8 is a front elevation view of an engine assembly shown in FIG. 2, shown partially in fragment and with its housing removed, showing the electronic servo module of FIG. 7, a shift actuator and a throttle actuator.

Referring now to FIG. 8, this shows engine 36 partially broken away. The electronic servo module 62 is shown as installed in a typical outboard engine, though other types of engines could be substituted. The positioning of shift actuator 64 and throttle actuator 66 are also shown, according to this example. With other engines other configurations may be used.

Figure 9:
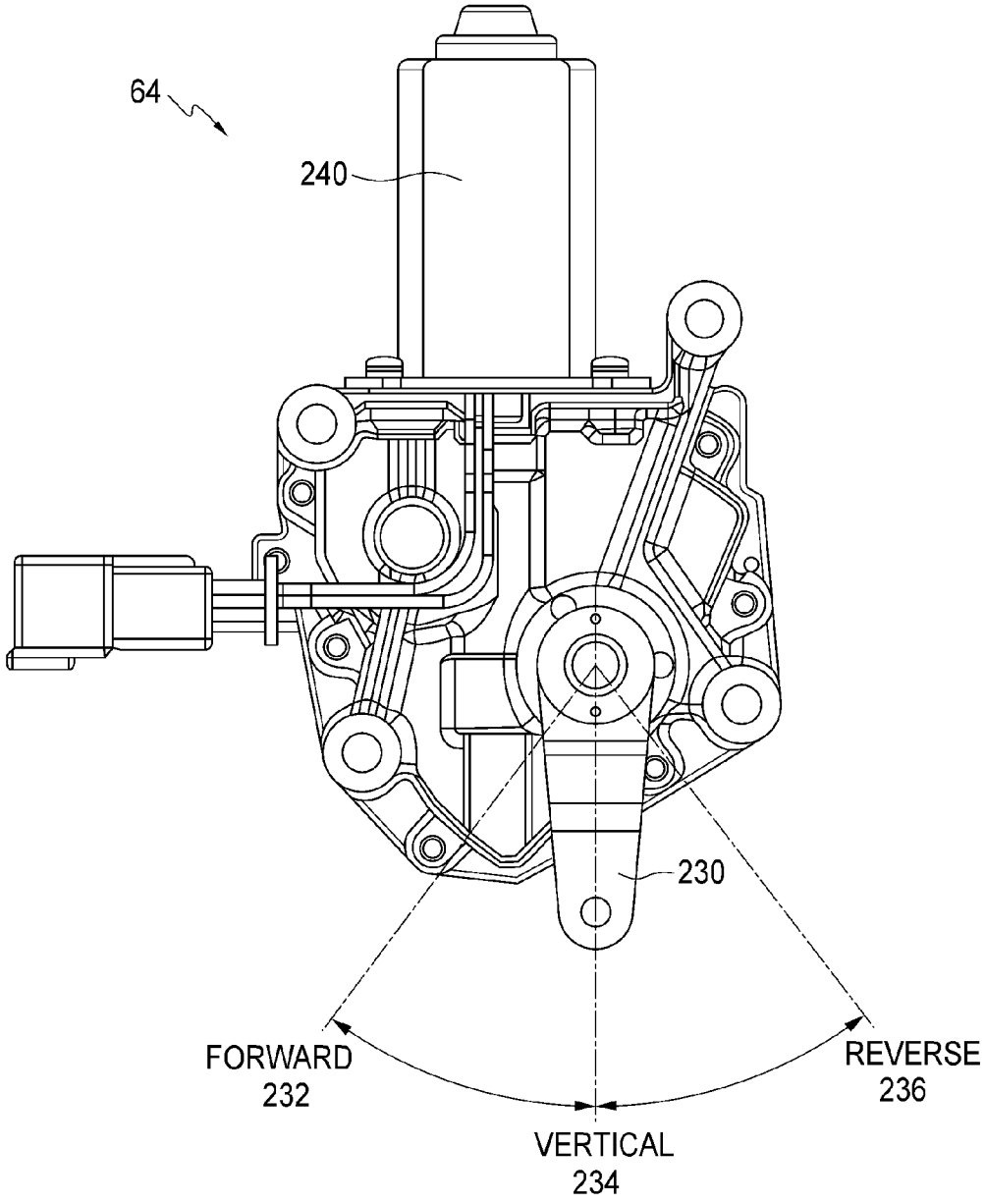
FIG. 9 is side elevation view of the shift actuator shown in FIG. 8 illustrating an operational range of an actuator arm thereof.
Figure 14:
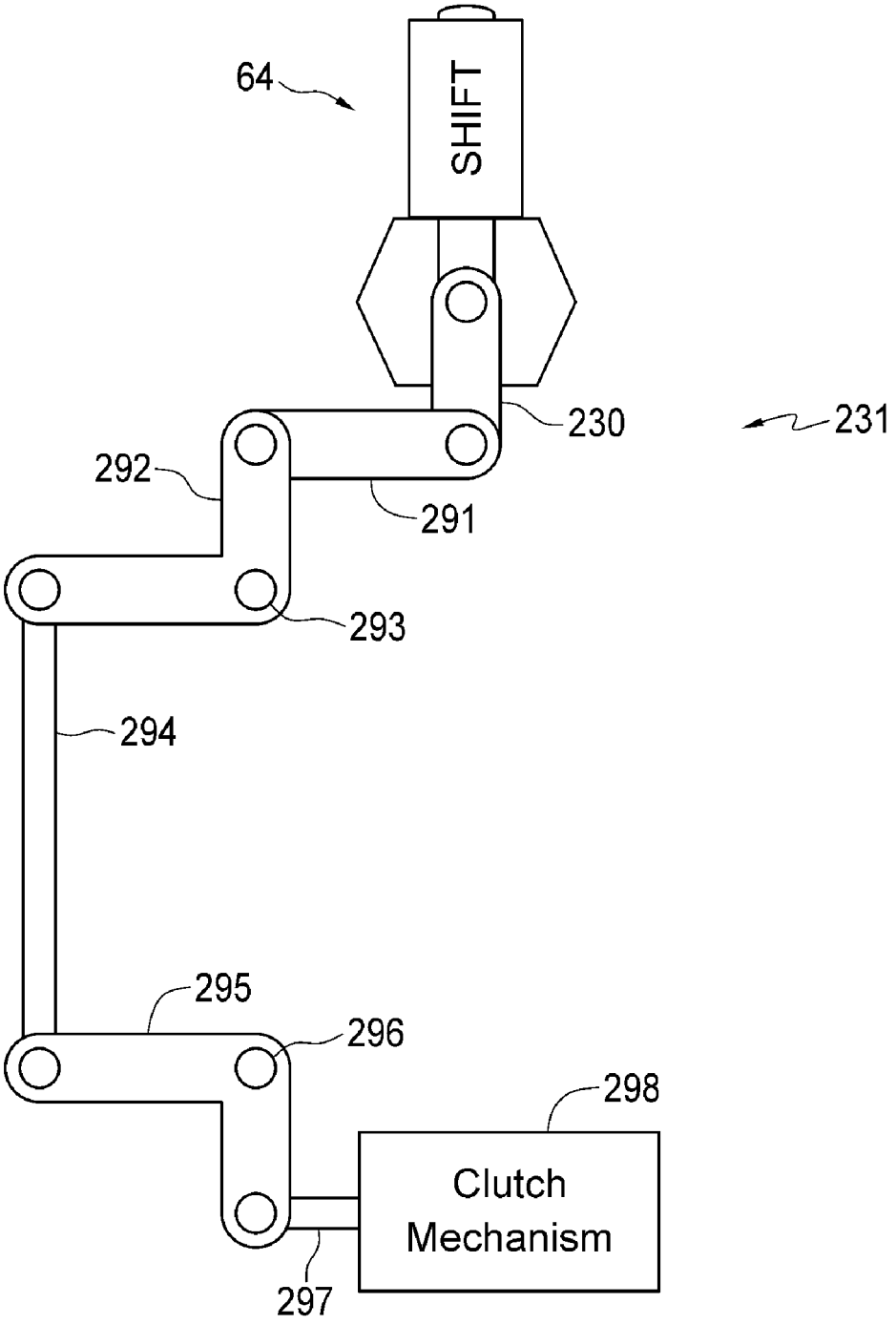
FIG. 14 is a simplified schematic view of the shift actuator of FIG. 9 connected via a shift linkage to a clutch mechanism.

FIG. 9 shows an example of shift actuator 64 in physical form. Shift actuator 64 has a shift linkage 231, shown in part via an actuator arm 230, that connects to a clutch mechanism 298 for shifting gears, as shown in FIG. 14. The actuator arm 230 which is rotatable between a forward position 232, a neutral position 234, and a reverse position 236. The actuator arm 230 causes the engine to engage a forward gear when the arm 230 is in the forward position 232. The actuator arm 230 causes the engine to engage a reverse gear when the arm 230 is in the reverse position 236. The neutral position 234 comprises the position between the forward position 234 and the reverse position 236 where the gears of the engine are disengaged or put another way in a neutral gear position. The operation of shift actuators for shifting gears is known per se and will not be discussed further.

Figure 10:
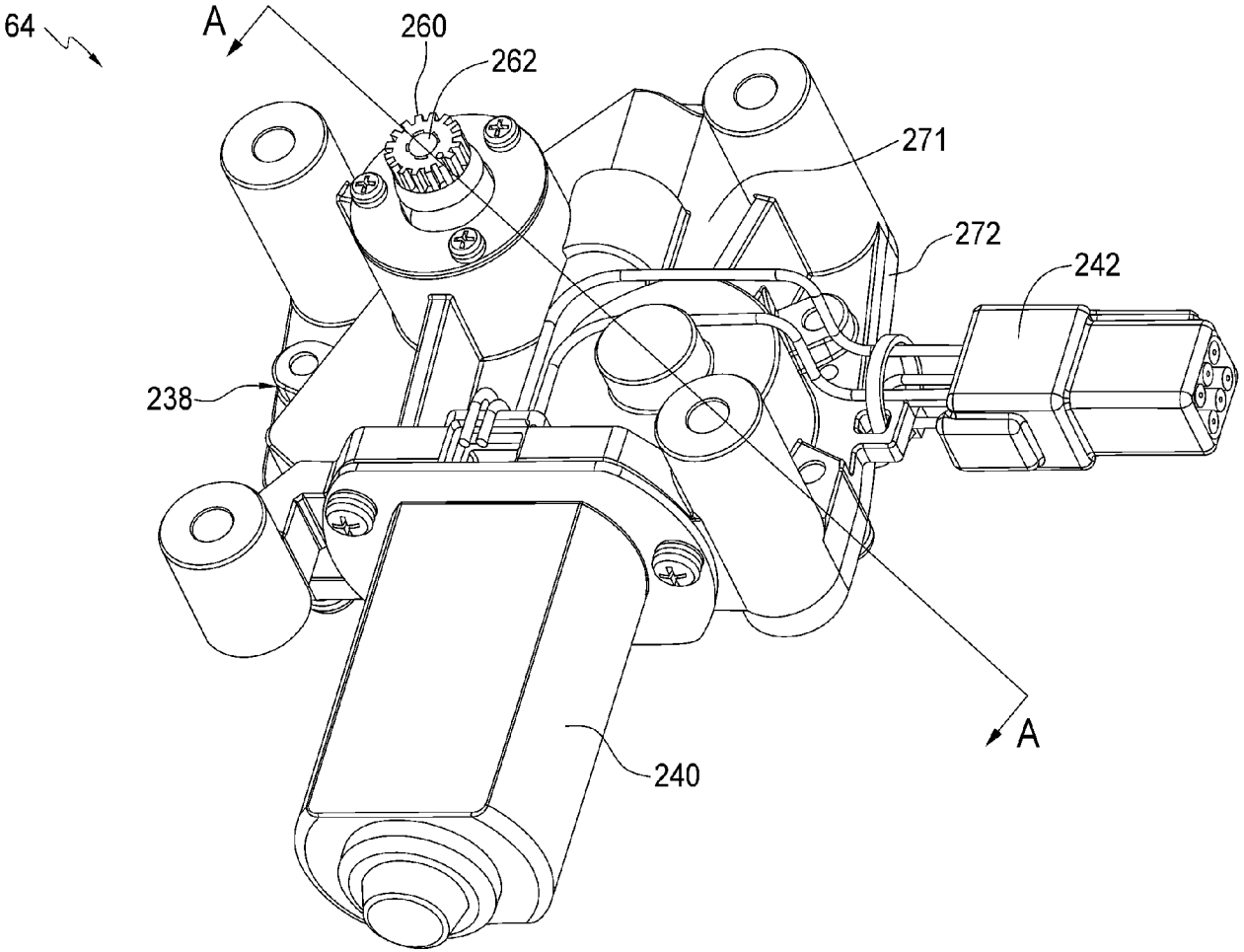
FIG. 10 is a perspective view of the shift actuator of FIG. 9 illustrating a first side.

Referring to FIG. 10, this shows the shift actuator 64 in a perspective view. The shift actuator 64 generally includes a waterproof housing 238. Housing 238 includes a body 271 and a cover 272. The housing 238 encases various components, a motor 240 extending from and bolted to the housing 238, and a harness 242 for electrically connecting the shift actuator 64 to the electronic shift and throttle system 25, shown for example in FIG. 2. The harness 242 connects with connector 96, shown in FIG. 7, of electronic servo module 62.

Figure 11:
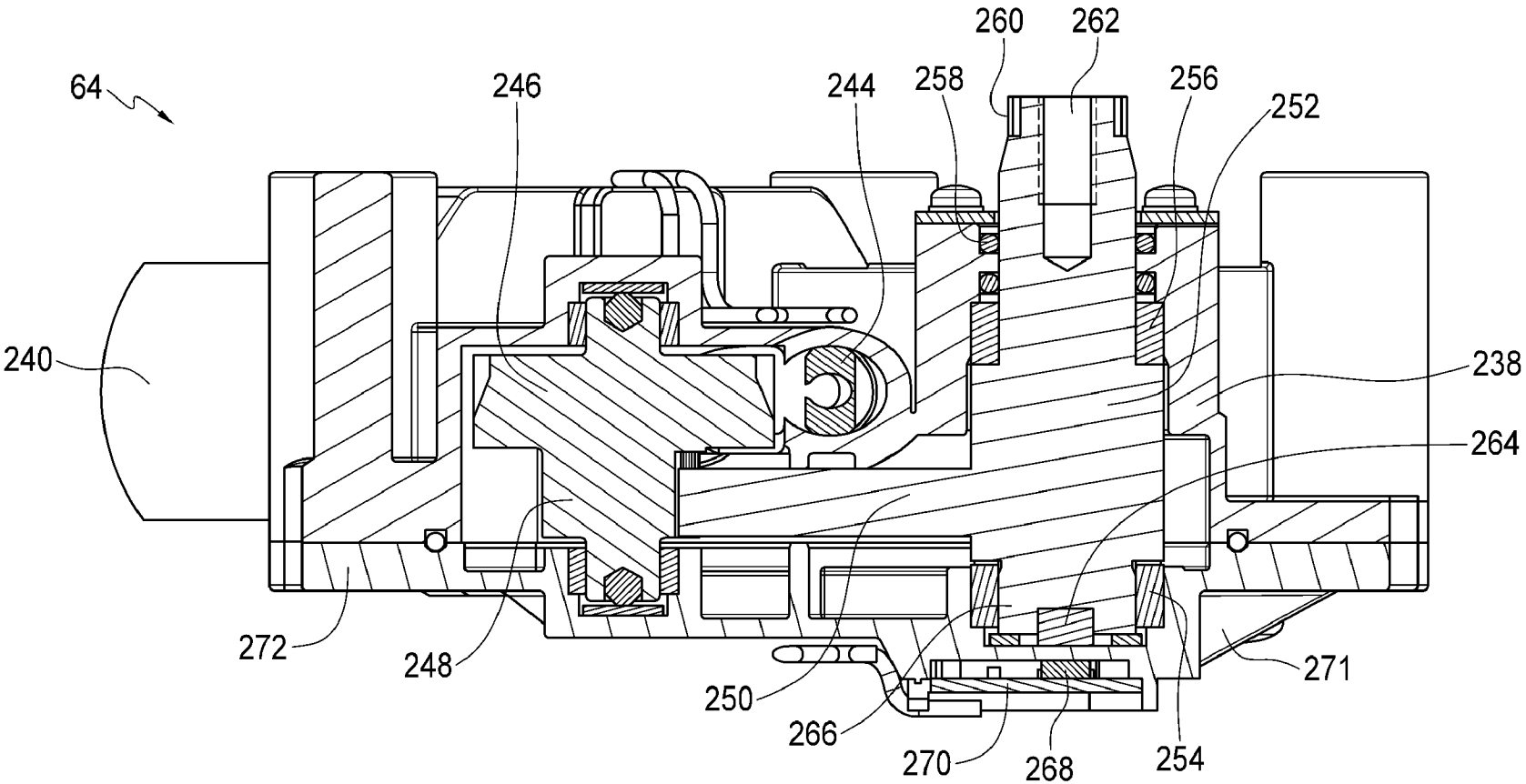
FIG. 11 is a sectional view taken along line A-A of FIG. 10.

Referring to FIG. 11, this shows a sectional view of shift actuator 64 taken along line A-A of FIG. 10. The housing 238 encases a worm gear 244 which is coupled to an output shaft (not shown) of the motor 240. The worm gear 244 engages a worm wheel 246 which is integrated with a spur gear pinion 248 thereby imparting rotary motion to both the worm wheel 246 and spur gear pinion 248. The spur gear pinion 248 imparts rotary motion to a sector spur gear 250 which is integrated with an output shaft 252 of the shift actuator 64. The output shaft 252 is thereby rotated by the motor 240. Bearings 254 and 256 are provided between the output shaft 252 and the housing 238 to allow free rotation of the output shaft 252 within the housing 238. A sealing member in the form of an O-ring 258 is provided about the output shaft 252 to seal the housing 238.

A distal end 260 of the output shaft 252 is splined. There is a longitudinal, female threaded aperture 262 extending into the output shaft 252 from the distal end 260 thereof. The aperture 262 is designed to receive a bolt to couple the output shaft 252 to the actuator arm 230 shown in FIG. 9. The splined distal end 260 and aperture 262 of the output shaft 252 are also shown in FIG. 10.

Referring to FIG. 14, the shift linkage 231 is shown in greater detail, according to one example. The shift actuator 64 is connected to the clutch mechanism 298 via the shift linkage 231. The shift linkage 231 includes the shift actuator arm 230. The shift linkage 231 also includes a shift link 291 pivotally connected the arm 230. The shift link 291 is pivotally connected to one end of a top shift bracket 292, which in this example is L-shaped. The top shift bracket 292 pivots via pivot point 293. The shift linkage 231 further includes a shift rod 294 connected to another end of the top shift bracket 292. The shift linkage 231 further includes a lower shift bracket 295 also connected to the shift rod at an end thereof opposite the top shift bracket. The lower shift bracket 295 pivots via pivot point 296 and is also L-shaped, in this example. The shift linkage 231 includes linkage 297 which engages and disengages the clutch mechanism 298. The functioning of clutch mechanisms for shifting gears, and its connections thereto, are known per se and so will not be discussed further.

Referring back to FIG. 11 and the shift actuator 64, there is a magnet 264 disposed at a proximal end 266 of the output shaft 252. There is also a position sensor, in this example a shift actuator position sensor 268, which senses a position of the magnet as the output shaft 252 rotates. The position sensor 268 is thereby able to determine the rotating position of the output shaft 252. In this example, the position sensor 268 is a Hall Effect sensor but in other embodiments the sensor may be a magnetoresistive position sensor or another suitable sensor. The position sensor 268 is mounted on a circuit board 270 which is mounted on the shift actuator housing 238. More specifically, in this example, the circuit board 270 is mounted on the housing cover 272. The position sensor 268 is thus integrated within the shift actuator 64.

Figure 12:
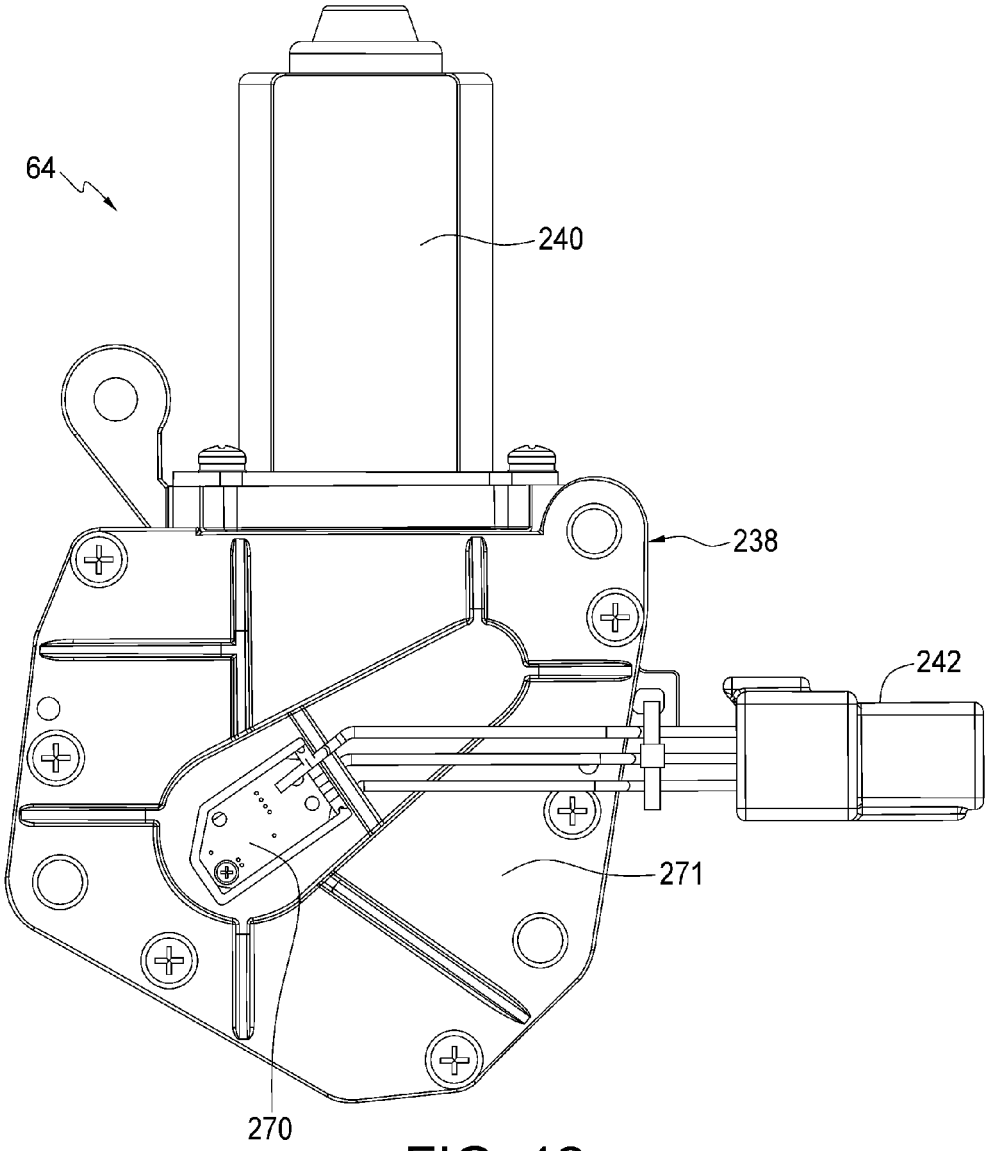
FIG. 12 is a side elevation view of the shift actuator of FIG. 8 illustrating a second side thereof.

As best shown in FIG. 12, the circuit board 270 is wired to the harness 242 allowing the position sensor 264, shown in FIG. 11, to send an electrical signal to the electronic servo module 62, which is shown in FIG. 13. The shift actuator position sensor 268, shown in FIG. 11, thus signals the shift actuator position to the electronic servo module 62. This feedback may be used to govern the control head 28.

The structure of the throttle actuator 66 in this example is substantially the same as that described for the shift actuator 64 in FIGS. 9 to 12. The throttle actuator 66 and its various parts will therefore not be described in great detail.

Figure 15:
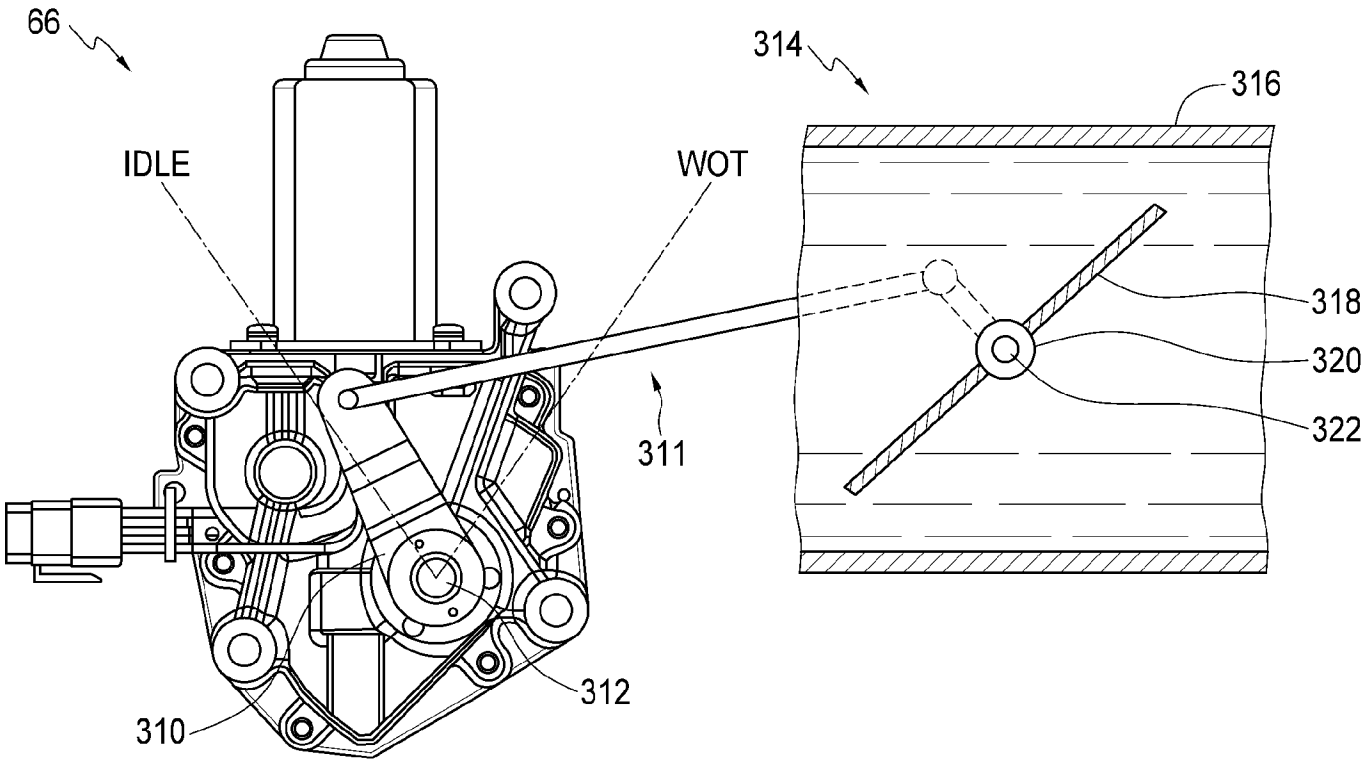
FIG. 15 is a fragmentary side view, partially in section and partly schematic, of a throttle actuator of FIG. 2, a throttle, and a linkage therebetween.
Figure 17:
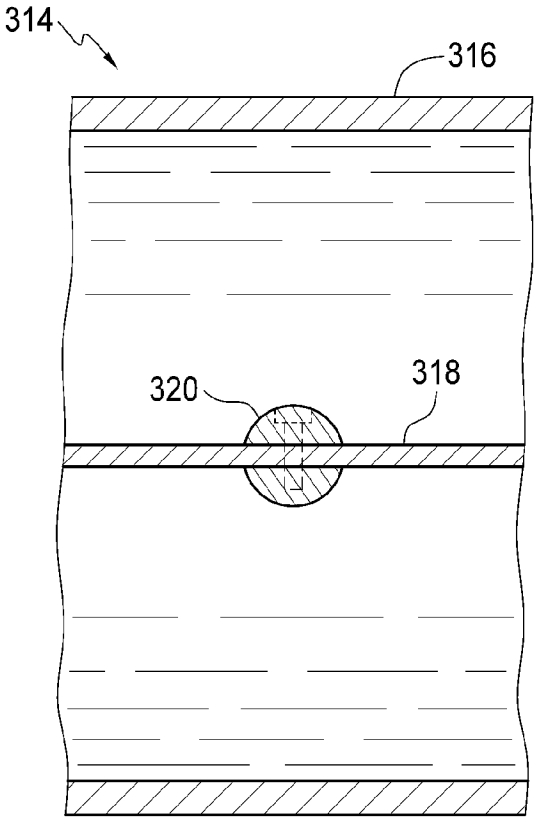
FIG. 17 is a sectional view of throttle of FIG. 15 illustrating the throttle in a wide open throttle (WOT) position.
Figure 16:
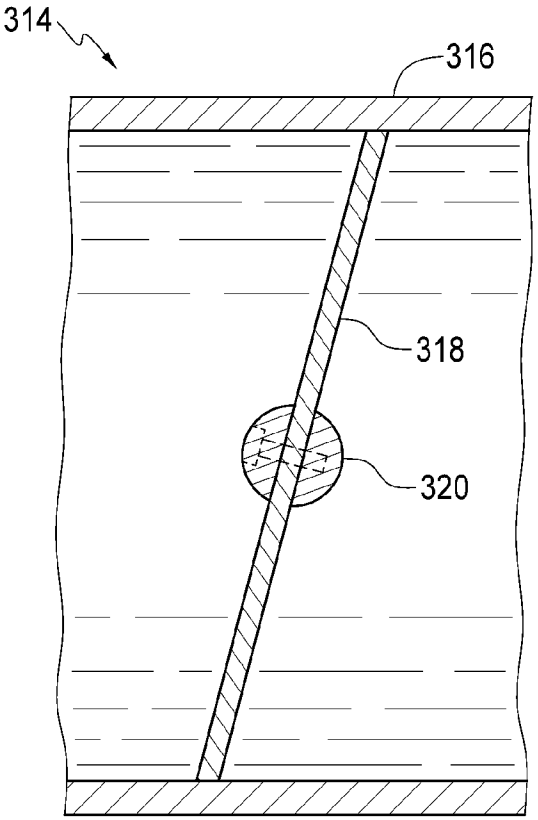
FIG. 16 is a sectional view of the throttle of FIG. 15 illustrating the throttle in an idle position.

Referring to FIG. 15, the throttle actuator 66 has a throttle actuator arm 310 coupled to an output shaft 312 of the throttle actuator 66. The throttle actuator 66 is coupled to a throttle 314 of engine 36, shown in FIG. 2, by a throttle linkage 311. The throttle linkage 311 may include the throttle actuator arm 310. The throttle 314 includes a throttle body 316 and a throttle plate 318 mounted on a rotatable throttle shaft 320. There is also a throttle position sensor 322 mounted on top of the throttle shaft 320 which senses the position of the throttle shaft as it rotates. In this example, the throttle position sensor 322 is a potentiometer and communicates with the engine management module 68 shown in FIG. 2. Together the plate 318, the shaft 320 and the throttle position sensor 322 form a butterfly valve member which is spring loaded to a closed position shown in FIG. 16. Rotation of output shaft 312 drives the throttle actuator arm 310 to rotate the throttle shaft 320. Rotation of the throttle shaft 320 causes the throttle 314 to move between an idle position shown in FIG. 16 and a Wide Open Throttle (WOT) position shown in FIG. 17. Whether the throttle 314 is in the idle position or WOT position is dependent on the rotational position of output shaft 312. The throttle actuator thus has position sensors that may be used to generate a signal indicative of the position of the throttle 314.

Before starting the engine, particularly after the electronic shift and throttle system 25 is powered on, each electronic servo module 62 checks if its associated shift actuator arm 230 is in the neutral position and its associated throttle actuator arm 310 is in the idle position. If either one of the conditions is not met, electronic servo module 62 drives its associated shift actuator arm 230 to the neutral position and its associated throttle actuator arm to the idle position.

Referring now to FIG. 13, the operation of starting an engine of the marine vessel will now be described.

To a start an engine, for example engine 36, the start/stop switch 302 must be actuated to a start position and this enables a switch-on message, which may be a voltage or other signal. The control head 28 receives the switch-on message and determines whether the associated lever, in this case the port control lever 202, is in neutral position 228, as shown in FIG. 4. The control head 28 determines this by processing the signal from the control lever position sensor 203. If the lever 202 is not in a neutral position, but rather in anyway in the forward or reverse position ranges of the levers, the control head 28 does not allow the engine 36 to start. If the switch 302 has been actuated to the start position and the lever 202 is in a neutral position, the control head 28 sends an engine start message/command 274 to the electronic servo module 62 over the CANbus communications network 42. The start command 274 continues to be broadcast for as long as the start/stop switch 302 is in the start position and the lever 202 is in neutral.

Upon receiving the start command 274 from the control head 28, the electronic servo module 62 determines whether its associated shift actuator 64, and more specifically shift actuator arm 230, is in a neutral position 234, as shown in FIG. 9. The electronic servo module 62 determines this by processing the signal from the shift actuator position sensor 268, shown in FIG. 11. The signal is represented by numeral 275 in FIG. 13. If the shift actuator arm 230 is not in the neutral position 234, but rather in a forward position 232 or reverse position 236 or in anyway in the forward or reverse position ranges, the electronic servo module 62 does not allow the engine 36 to start and keeps its start output off. If the start switch 302 is in the start position and either the associated control lever 202 and/or shift actuator 64 is not in neutral, then the control head 28 sends a neutral start protection alarm on the private CANBus communications network 42.

If the electronic servo module 62 has received the start command 274 from the control head 28 and the shift actuator arm 230 is in a neutral position, the electronic servo module 62 activates a start output 276. The start output 276 is a voltage signal, in this example, connected to the engine management module 68. The voltage signal is retrofittable to the engine management module, which used to be signalled by a discrete start switch. Alternatively, the start output can be a drive signal to engage the starter solenoid 67 directly. The start output 276 can also be another CANbus message, or a serial communication means, to communicate with the engine management module 68 to start the engine 36.

Upon the engine management module 68 receiving the start output 276, the engine management module 68 causes the engine 36 to start. The engine management module 68 transmits a start output 278 to activate the starter solenoid 67 of the engine 36. The starting of an engine 36 via an engine management module 68 is known per se and therefore will not be described further. The engine management module 68 continues to activate the start solenoid 67 for as long as the start output 276 of the electronic servo module 62 is being transmitted and the engine 36 is not running. The engine management module 68 determines if the engine 36 is running using a motor speed sensor 79 to monitor motor speed 280. Motor speed sensors per se are known and therefore will not be described further. In one preferred example, the engine 36 is deemed to be running if its speed is above 300 RPM. In the variation as previously mentioned the electronic shift and throttle system 25 can drive the start solenoid 67 directly. This is shown in FIG. 13 by the doted line of numeral 279 connecting the starter output 276 directly with the starter solenoid 67, instead of with the engine management module 68. The electronic shift and throttle system 25 can read the engine's RPM either directly with tachometer signal or with serial communication.

The system 25 as herein described thus acts as a redundant neutral start-protection system for the engines. The engine 36 will start only if both the associated control lever and the shift actuator are in neutral. Thus, for example, if faults occur with the detection of the control lever position, the system will nonetheless prevent the starting of the engine unless the shift actuator 64 is also in neutral. The system thereby provides an enhanced layer of safety. The system 25 may also inhibit damage to the engines that otherwise may occur if the engines were started with the shift actuators in a non-neutral position.

In addition to monitoring the control lever position(s) and the shift actuator arm position, the electronic servo modules 62 check for any active critical faults. Critical faults include a shift actuator position sensor fault, a throttle actuator position sensor fault, and a throttle actuator motion fault. The electronic servo modules 62 will not activate their corresponding start output 276 if they detect any active critical faults.

The control lever position must be correspond to a neutral and idle position for the start message to be issued. When the control lever 202 is in neutral and idle, the control head 28 will send a message to the electronic servo modules 62 to bring their corresponding shift actuator arms to neutral and to bring their corresponding throttle actuator arms to idle. If a given throttle actuator arm 310 cannot move to the idle position, because for example a physical obstacle is in the way of the arm movement, the corresponding electronic servo module 62 will declare a throttle motion fault. In other words, the start protection includes a throttle idle check as well.

In addition, if any of sensors, such as control lever position sensors 203 and 205, shift actuator position sensors 268, and throttle position sensors, are not working, the start output 276 will not be issued. The above described features thus add further levels of safety to the system 25.

To stop the engine 36, the start/stop switch 302 is actuated to a stop position. This may enable a switch-off message. This actuation of the switch 302 is detected by the control head 28 via, for example, the switch-off message. The control head 28 as a result sends an engine stop message 282 via the CANbus communications network 42 directly to the engine management module 68. The control head 28 transmits the stop message 282 regardless of the position of the lever 202 and regardless of the position of the shift actuator 64, and more particularly shift actuator arm 230. Put another way, upon the start/stop switch 302 being actuated to the stop position, the control head 28 transmits the stop message 282 for all positions of the control lever 203 and for all positions of the shift actuator. The stop command 282 continues to be broadcast to the engine management module 68 for as long as the start/stop switch 302 is in the stop position.

When the engine management module 68 receives the stop message 282, the engine management module 68 causes the engine 36 to stop. The details of how an engine management module causes an engine to stop are known per se and therefore will not be described.

Thus, the engine 36 can be stopped at any time upon the start/stop switch 302 being actuated to the stop position.

The system 25 as herein described enables a plurality of engines to be selectively started or stopped all along a single communications link, in this example via the CANbus communications network 42. The system thus represents a multiplexed start/stop system.

The system 25 also includes an emergency stop switch, in this example, a lanyard switch 284 connected to the CANbus communications network 42 via the input/output pin 48. The lanyard switch 284 is connected to all engines 36, 36.1, 36.2, 36.3, and 36.4 using two dedicated, emergence stop conductors, in this example, wires 288 and 290. The stop wires 288 and 290 are connected to the lanyard switch 284. The stop wires 288 and 290 are connected to the input/output pin 48. The lanyard switch 284 can be tethered to the driver to emergency shut off all the engines of the marine vessel. The control head 28 and the electronic servo modules 62 read the lanyard switch state through the two stop wires 288 and 290. Either one of them (either control head 28 and/or the electronic servo modules) can transmit the lanyard signal through the CAN bus, or another electrical signal such as serial communication, to the engine management modules 68 as a redundant safety signal to shut down all the engines in case the two dedicated wires failed open circuit or closed circuit. This is non-obvious, because the failure causes of the two dedicated wires and the CAN bus would likely be different. This drastically increases the availability and reliability of the system. The emergency stop wires 288 and 290 and the communication wires together may be bundled into a single cable jacket. Put another way, the two dedicated stop wires 288 and 290 in this example are part of a cable that is shared with the CAN communication. When the lanyard switch 284 is actuated, all engine management modules immediately cause their associated engines to stop running.

Put another way the master key switch panel integrates 46 a safety lanyard that connects to the emergency stop wires 288 and 290 of the engine(s). Pulling the safety lanyard connects the stop wires together which immediately stops the engine. On multiple engine applications, all stop wires are connected together, so pulling the lanyard stops all engines simultaneously. Pulling the master key switch panel 46 safety lanyard also turns the key switch off and hence shuts the system 25 down.

Lanyard and stop functions have traditionally been independent of shift and throttle. This is because it is not easily achievable to stop the engine via a serial communication scheme. Problems may be particularly compounded in the case of multi-engine systems.

The present system 25 with its incorporated emergency stop wires as herein described advantageously achieves a high level of integration compared with traditional systems. It provides careful and improved architectural design in terms of network security, electrical signal compliance, communication protocol, division of functions and overall reliability and availability of the system.

Those skilled in the art will appreciate that many variations are possible within the scope of the invention as herein described. This description of a preferred embodiment focuses on monitoring the position of the shift actuator arm. Alternatively, a position sensor may be disposed adjacent to a shift tower or any linkage, such as a component of the shift linkage 231, connecting the shift actuator motor output shaft 252 to the clutch mechanism that is mechanically linked to the gear position for the monitoring of the gear position thereby.

It will be understood by someone skilled in the art that many of the details provided above are by way of example only and are not intended to limit the scope of the invention which is to be determined with reference to the following claims.

What is claimed:

1. A method for starting an engine of a marine vessel, the engine having gears and a shift actuator for operatively shifting the gears, the method comprising:

providing a first position sensor disposed to operatively sense whether the engine is in a forward, neutral or reverse gear position, the first position sensor generating a signal representative of the gear position;

disposing a second position sensor adjacent to a shift control which controls shift functions of the engine, the second position sensor generating a signal representative of the position of the shift control;

providing processing means, the processing means including a control head processor, the control head processor receiving the signal of the second position sensor and determining the position of the shift control, the processing means including a servo controller processor, the servo controller processor receiving the signal of the first position sensor and determining the gear position, the processing means receiving the signals of the position sensors, determining the gear position and the position of the shift control, and enabling the engine to start upon determining that both the shift control and the engine are in neutral positions; and providing a start switch connected to the control head processor, the control head processor transmitting an engine start message when the start switch is actuated and the control head processor determines that the shift control is in neutral, the servo controller processor transmitting a start output when the servo controller processor receives the engine start message and determines that the engine is in the neutral gear position, the start output operatively causing the engine to start.

2. The method as claimed in claim 1, wherein the shift control is a control lever.

3. The method as claimed in claim 1, the shifting actuator includes a shift actuator arm, and within the step of disposing the first position sensor, disposing the first position sensor adjacent to the position of the shift actuator arm.

4. The method as claimed in claim 1, wherein the shifting actuator operatively connects to a clutch mechanism via a shift linkage and wherein the first position sensor is adjacent to the shift linkage.

5. The method as claimed in claim 1, the engine including a starter solenoid, and the method further including:

the start output being in communication with the starter solenoid, being a drive signal and causing the engine to start via the starter solenoid.

6. The method as claimed in claim 5, wherein the start output is one of a voltage signal, a CANbus message and a serial communication means for communicating with the engine controller processor for starting the engine.

7. The method as claimed in claim 1, the processing means including an engine controller processor, and the method further including, within the enabling the engine to start step of the processing means, the engine controller processor receiving the start output and causing the engine to start.

8. The method as claimed in claim 7, the control head processor being part of a control head, the servo controller processor being part of a servo controller and the engine controller processor being part of an engine control unit, and wherein the control head, the servo controller and the engine control unit are connected together via a communications link.

9. The method as claimed in claim 7, the engine further including a starter solenoid, the engine controller processor actuating the starter solenoid to start the engine.

10. The method as claimed in claim 7, further including:

providing a stop switch for stopping operation of the engine, the stop switch connecting to the control head processor;

the control bead processor being connected to the engine controller processor and transmitting a stop message to the engine controller, processor to stop operation of the engine upon the stop switch being actuated; and the engine controller processor causing the engine to stop upon receiving the stop message.

11. The method as claimed in claim 10, wherein the control head processor transmits the stop message upon the stop switch being actuated for all positions of the shift control and for all gear positions.

12. The method as claimed in claim 1, wherein within the enabling the engine to start step, configuring the processing means to check for a fault in the functioning of the first position sensor, the processing means inhibiting the engine from starting if the processing means determines that said fault exists.

13. The method as claimed in claim 1, the engine including a throttle and a throttle actuator operatively connected to the throttle, and the method further including:

providing a third position sensor for operatively sensing the position of the throttle, the third position sensor generating a signal representative of the position of the throttle;

the processing means receiving the signal of the third position sensor and determining the position of the throttle;

when the shift control is in neutral, the processor means being configured to cause the engine to move to the neutral position and cause the throttle to move to an idle position; and within the enabling the engine to start step, the processing means inhibiting the engine from starting if the processing means determines that the throttle is inhibited from moving to the idle position.

14. The method as claimed in claim 1, the engine including a throttle and a throttle actuator operatively connected to the throttle, and the method further including:

providing a third position sensor for operatively sensing the position of the throttle, the third position sensor generating a signal representative of the position of the throttle;

within the enabling the engine to start step, configuring the servo controller processor to check for at least one fault in the functioning of the first position sensor, in the functioning of the third position sensor or in the throttle actuator's ability to move to an idle position, and the servo controller processor inhibiting the transmission of the start output if the servo controller processor determines that said at least one fault exists, the servo controller processor thereby inhibiting the engine from starting.

* * * * *

UNITED STATES PATENT AND TRADEMARK OFFICE

CERTIFICATE OF CORRECTION

PATENT NO. : 8,406,944 B2
APPLICATION NO. : 12/703527
DATED : March 26, 2013
INVENTOR(S) : Pierre Garon et al.

It is certified that error appears in the above-identified patent and that said Letters Patent is hereby corrected as shown below:

In the Claims

Col. 16 lines 31-40 should read:

10. The method as claimed in claim 7, further including: providing a stop switch for stopping operation of the engine, the stop switch connecting to the control head processor; the control head processor being connected to the engine controller processor and transmitting a stop message to the engine controller processor to stop operation of the engine upon the stop switch being actuated; and the engine controller processor causing the engine to stop upon receiving the stop message.

Signed and Sealed this
Eleventh Day of June, 2013

Teresa Stanek Rea
*Acting Director of the United States Patent and Trademark Office*